United States Patent [19]

Calais et al.

[11] 3,950,893

[45] Apr. 20, 1976

[54] CONTROL APPARATUS FOR HERMETICALLY CLOSING AN OPENING IN A WALL

[75] Inventors: Bernard Calais; Luis Vidal, both of Rambouillet, France

[73] Assignee: Societe Bernard Calais S.A.R.L., Rambouillet, France

[22] Filed: Feb. 5, 1975

[21] Appl. No.: 547,347

Related U.S. Application Data

[63] Continuation-in-part of Ser. No. 373,636, June 26, 1973, abandoned.

[30] Foreign Application Priority Data

July 3, 1972 France ..... 72.24565

[52] U.S. Cl. ..... 49/224; 49/235; 49/360

[51] Int. Cl.[2] ..... E05D 15/10

[58] Field of Search ..... 49/209, 212, 221, 234, 49/235, 280, 281, 409, 410, 224, 360

[56] References Cited

UNITED STATES PATENTS

| | | | |
|---|---|---|---|
| 3,197,817 | 8/1965 | Voris | 49/409 X |
| 3,621,349 | 11/1971 | Reyx | 49/360 X |

*Primary Examiner*—Kenneth Downey
*Attorney, Agent, or Firm*—Stevens, Davis, Miller & Mosher

[57] ABSTRACT

Control apparatus for a device for hermetically closing an opening in a wall, which device includes a leaf movable from a hermetically closed position to a disengaged position in which it is slidable along a rail. The control apparatus includes a drive mechanism for moving the leaf from the hermetically closed position to the disengaged position and a linear electric motor for sliding the leaf along the rail, the linear motor including a first element secured to the leaf and a second element secured to the wall.

5 Claims, 9 Drawing Figures

CONTROL APPARATUS FOR HERMETICALLY CLOSING AN OPENING IN A WALL

This application is a continuation-in-part of application Serial No. 373,636, filed June 26, 1973 now abandoned.

The present invention relates to a control apparatus associated with a device for hermetic closure of an opening formed in a wall. This device includes a leaf which is provided with seals positioned on its lower edge and on the lateral and upper edges of its face which is turned towards the wall. The leaf, which is a closure device, is mounted slidably on a section rail rigidly attached to the wall. The control apparatus includes a movement and guiding means for moving and guiding the leaf between a disengaged position permitting free sliding of the leaf along the rail and a hermetic closure position which is lower than the disengaged position and in which the leaf is applied against the wall in the position of the opening so as to close the latter hermetically.

To place the leaf in the disengaged position, an opening force is initially applied to the leaf. This force is of sufficient magnitude to permit movement of the leaf from its hermetic closure position to its free sliding position. Then a sliding force, which is much smaller than the opening force, is applied to the leaf to bring it into a position to open the opening in the wall.

The present invention relates to an apparatus which can provide this opening force and this sliding force at the right moments to be able to open or close the opening with the leaf of the above-mentioned device. The opening force is obtained, in accordance with the invention, with apparatus which comprises drive means which can move the leaf from its hermetic closure position into its free sliding position. To power the sliding of the leaf, the apparatus includes a known linear electric motor, having a first element rigidly attached to the wall, and a second element rigidly attached to the leaf to provide the sliding force. Such an apparatus thus enables the sliding leaf to open and close the wall opening automatically.

Other features and advantages of the invention will become apparent on reading the description of two embodiments which is given below for guidance and is non-limiting, which description is made with reference to the attached drawings.

Figure 8A:
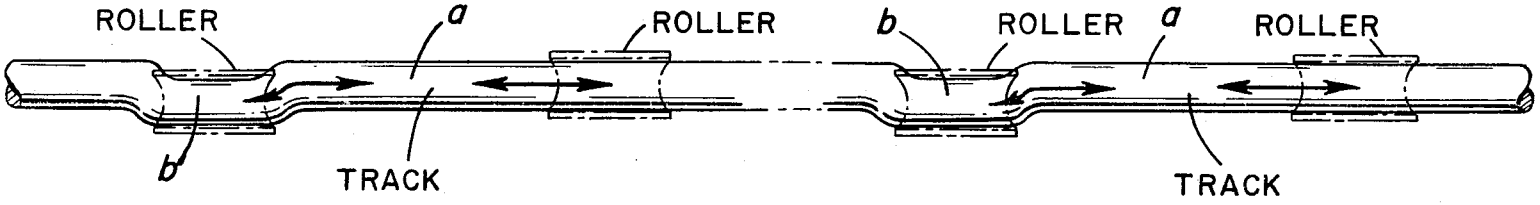

FIG. 8*a* is a diagrammatic illustration in top plan of a rail used in both embodiments of the present invention.

Figure 8B:
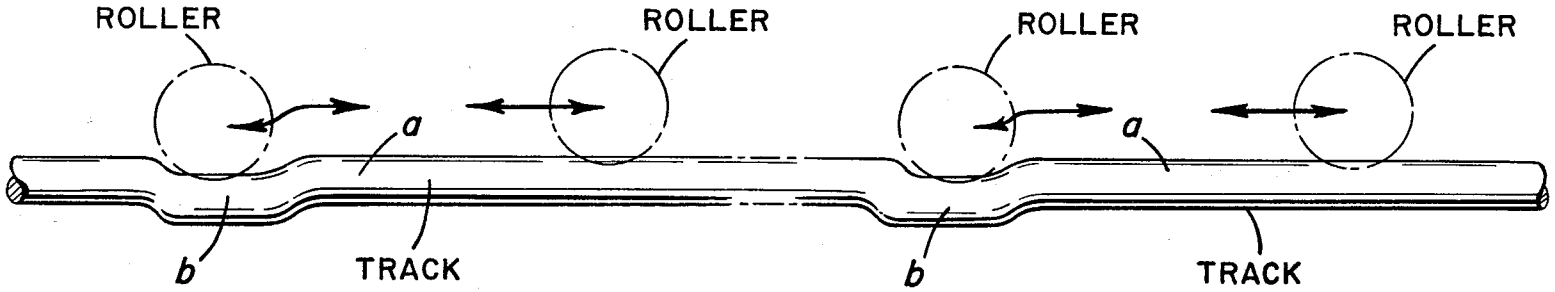

FIG. 8*b* is a diagrammatic illustration in elevation of the rail used in both embodiments of the present invention.

The drawings show a device for hermetic closure of an opening 1 formed in a wall 2. The closure device comprises a leaf 3, which is provided with seals 30 such as those shown in FIGS. 6 and 7. These seals 30 are positioned on the lower edge of the leaf 3 and on the lateral and upper edges of its face which is turned towards wall 2. Leaf 3 is mounted slidably by means of suspension rollers 31 (FIGS. 6 and 7), along a horizontal section rail 4 rigidly attached to wall 2.

A control apparatus for the closure device comprises movement and guide means for moving and guiding leaf 3 between a disengaged position allowing free sliding of the leaf 3 along rail 3 and a hermetic closure position which is lower than the disengaged position and in which the leaf 3 is applied against wall 2 in the position of opening 1, so as to close the latter hermetically. The disengaged position is shown in solid lines in FIGS. 2, 4 and 7 and the hermetic closure position is shown in chain-dotted or solid lines in FIGS. 1, 3 and 6.

The closure device shown in the drawings is fitted with an apparatus for controlling the opening and closure of leaf 3. This apparatus comprises in combination drive means which can move the leaf 3 from its heremtic closure position into its disengaged position and, in a known manner, a linear electric drive motor 16 to power the sliding of leaf 3 along rail 4. One of the elements of motor 16, consisting of primary 16*a* in the present case, is rigidly attached to wall 2, and the other element of motor 16, consisting of secondary 16*b*, is attached to the upper edge of the metal suspension framework 3*b* of leaf 3.

In the two embodiments of the invention, the above-mentioned drive means is constructed as a thrust means which can apply to leaf 3, in its hermetic closure position, an opening force of appropriate direction and sufficient magnitude to enable the leaf 3 to be moved from its hermetic closure position into its disengaged position as will be more fully discussed.

Figure 1:
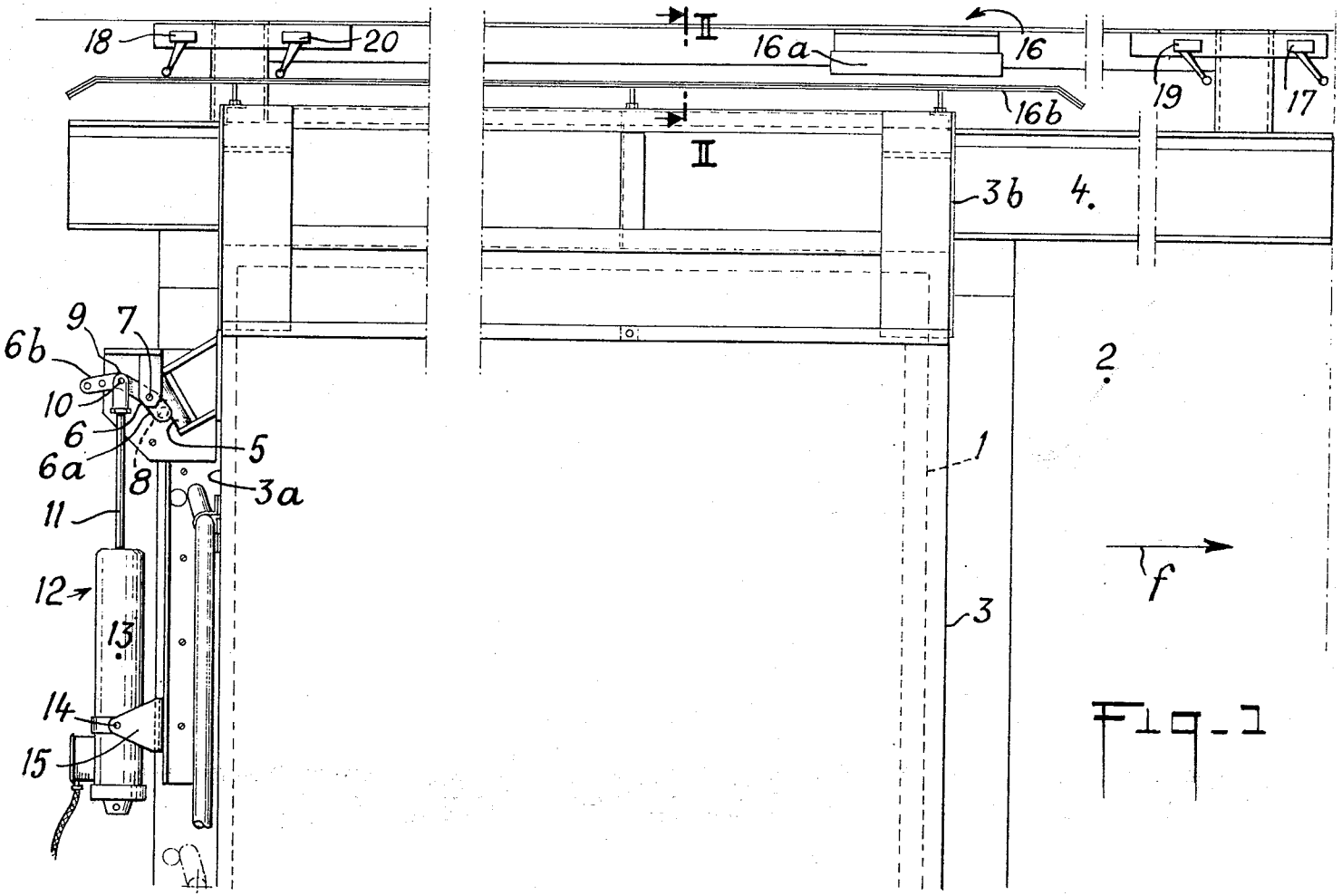
FIG. 1 is an elevation of the apparatus in accordance with a first embodiment of the invention.
Figure 2:
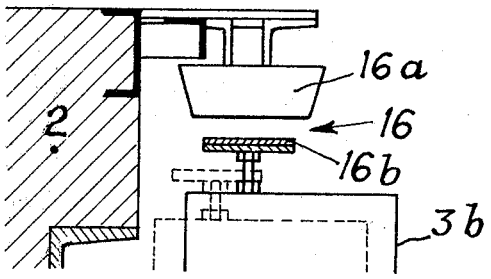
FIG. 2 is a vertical, partial cross-section, along the line II—II of FIG. 1.

In accordance with the embodiment shown in FIGS. 1 and 2, leaf 3 has, on its lateral edge 3*a*, a cylindrical thrust surface 5, which is turned downwards and inclined to the vertical toward surface 3*a* by an angle which is 30° in the example shown, but could have another value between 15° and 30°. Leaf 3 is moved by the above-mentioned thrust means in the opening direction shown by arrow *f* on FIG. 1.

The thrust means consists of a double-arm lever 6 which is mounted on an axis 7 attached to wall 2. One arm 6*a* of lever 6 is cranked at bend 9 and is pivoted at that point, or beyond bend 9, on a horizontal axis 10 rigidly attached to the end of the rod 11 of an electric ram 12 such as a solenoid, the axis of which is vertical and the fixed element of casing 13 of which is pivoted about a horizontal axis 14 mounted on a clevis 15 attached to wall 2.

In the example shown in FIG. 1, thrust surface 5 is constructed as a cylindrical sleeve mounted on an arm which is itself inclined at 30° to the vertical and which is attached to the lateral edge 3*a* of leaf 3. Thus, electric ram 12 and lever 6 together constitute a thrust organ which can apply to thrust surface 5 a force substantially perpendicular to the latter, which tends to move leaf 3 in the opening direction from the hermetic closure to the disengaged position.

As shown in FIGS. 8*a* and 8*b* the rail 4 along which leaf 3 slides includes sections *a* on which the leaf slides freely in the disengaged position and two lowered sections *b* for the two respective rollers 31 on which the leaf will be in the hermetic closure position. The two lowered sections *b* or rail 4 extend downwardly and inwardly towards the wall 2 from the rail sections *a*, as shown by the solid and dotted lines of FIG. 6.

In the hermetic closure position, as mentioned above, rollers 31 are in the two lowered sections t*b* of rail 4. The leaf 3 is moved from sections *b* ) to *a* of rail 4 in response to the force applied substantially perpendicular to surface 5. This perpendicular force includes components in the vertical and horizontal direction which act on surface 5 and hence leaf 3. The vertical component provides a lifting force whereas the horizontal component provides a sliding force. By proper design of the thrust means including lever 6, rod 11 and ram 12, sufficient vertical and horizontal force components act on the surface 5 to lift and move the rollers out of sections *b* onto sections *a* of rail 4. The perpendicular force acting on surface 5 is applied at only one lateral edge 3*a* of the leaf 3; however, this is satisfactory to move both rollers 31 and hence the other lateral edge of the leaf 3 from the hermetic closure to the disengaged position.

Still in accordance with the embodiment shown in FIGS. 1 and 2, secondary 16*b* is so arranged relative to fixed primarly 16*a* as to cooperate with the latter when leaf 3 is in the disengaged position which is shown in solid lines in FIG. 2. However, secondary 16*b* is beyond the influence of the primary 16*a* when leaf 3 is in its hermetic closure position which is shown in dotted lines in FIG. 2.

As shown in FIG. 1, the apparatus also includes, in association with linear motor 16, an opening limit switch 17 and a closure limit switch 18. Switches 17 and 18 are each inserted in the supply circuit of linear motor 16 and are mounted rigidly on wall 2 in respective positions such that the switches 17 and 18 cooperate with mobile section element 16*b* to break the electrical supply of linear motor 16 when leaf 3 is in the disengaged position and respectively adjacent to its opening limit position and its closure limit position.

Linear motor 16 is also associated with a braking opening limit switch 19 and a braking closure limit switch 20 which are each mounted rigidly on wall 2 between stop switches 17 and 18. The switches 19, 20 cooperate with mobile section element 16*b* to reverse the direction of the force developed by linear motor 16 on the mobile element 16*b* when leaf 3 is adjacent to its opening limit position and its closure limit position respectively.

Figure 7:
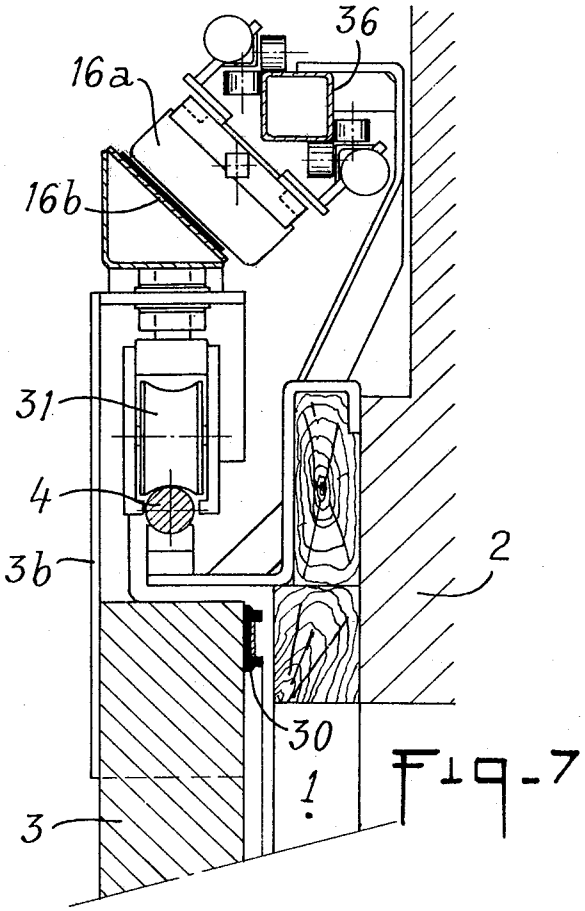
FIG. 7 is a vertical, partial cross-section along the line VII—VII of FIGS. 4 and 5.
Figure 6:
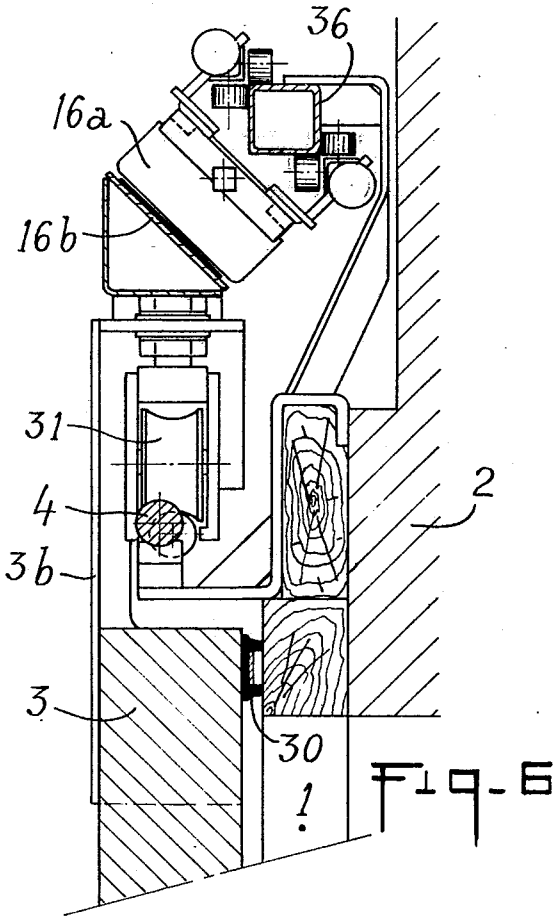
FIG. 6 is a vertical, partial cross-section along the line VI—VI of FIG. 3.

In accordance with the embodiment shown in FIGS. 3 to 7, the two elements 16*a* and 16*b* of linear drive motor 16 are arranged relative to each other in such a way that they cooperate with each other, both when leaf 3 is in the disengaged position shown in FIG. 7 and when the leaf 3 is in the hermetic closure position shown in FIG. 6. For this purpose, and as shown in FIGS. 6 and 7, the opposed faces of the primary 16*a* and secondary 16*b* elements of the linear motor 16 are flat, mutually parallel, extend parallel to rail 4 and are downwardly inclined to the vertical towards wall 2. Furthermore, the means for moving and guiding leaf 3 is designed to guide the leaf 3 along a substantially rectilinear path parallel to the opposed faces of elements 16*a* and 16*b*. Due to this arrangement, when leaf 3 is moved between its disengaged position and its closure position, the air gap existing between primary 16*a* and secondary 16*b* retains a constant value.

In accordance with the embodiment shown in FIGS. 3 to 7, the drive means includes a double arm lever 32 which is mounted to rock on a fixed axis 33 which is perpendicular to the external face of wall 2 and to rail 4. The lever 32 is pivotally linked by the end of one of its arms 32*a*, by means of a rod 34, to primary element 16*a* of linear motor 16. The other arm 32*b* of lever 32 is arranged relative to leaf 3 to move the latter from its hermetic closure position into its disengaged position. For this purpose, the free end of arm 32*b* carries a roller 35 which can be applied against the lateral edge face 3*c* of leaf 3.

Primary element 16*a* of linear motor 16 is slidably mounted, along a path limited in the two directions by two limit stops 36*a* and 36*b*, along a horizontal slide 36 parallel to rail 4 and attached to wall 2. Stop 36*a*, situated on the opening direction side of leaf 3 ( to the left in FIGS. 3 to 5) includes an arm 37 which is attached to slide 36 perpendicularly to the latter and which carries two elastic buffers 38 which can cooperate with corresponding counter stop faces of primary element 16*a*. Stop 36*b*, situated on the closure direction side of the leaf (arrow $f_1$), i.e., to the right in FIGS. 3 to 5, includes a support 39 which is attached to the slide 36 and which supports, pivotally about a horizontal axis, two arms 40 situated on either side of slide 36 and each carrying an elastic buffer 41. Each arm 40 is associated with a spring (not shown) biasing the arm 40 into a position in which the latter is inclined towards slide 36.

Figure 3:
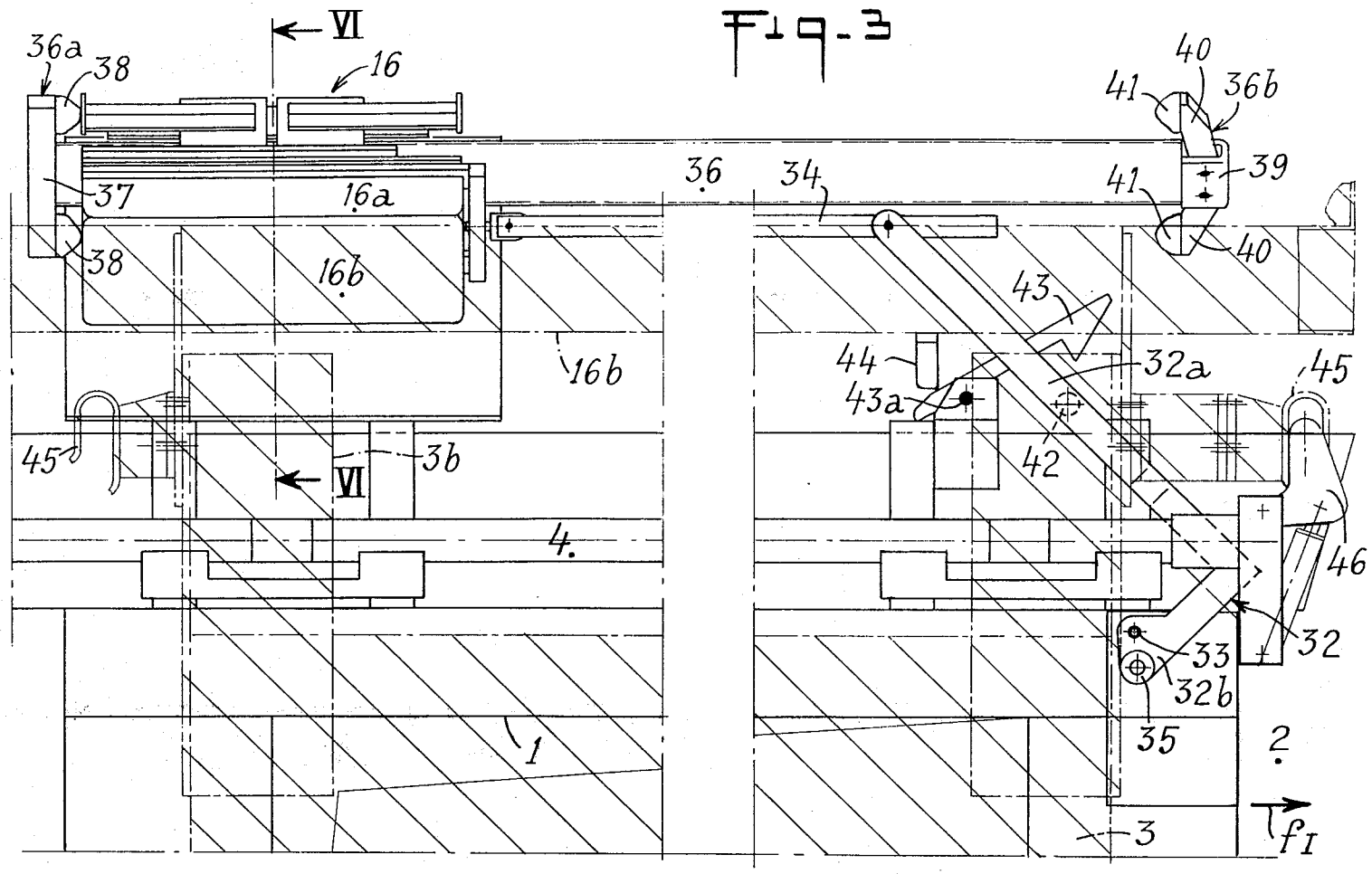
FIG. 3 is an elevation of the apparatus in accordance with a second embodiment, with the leaf in the hermetic closure position.
Figure 4:
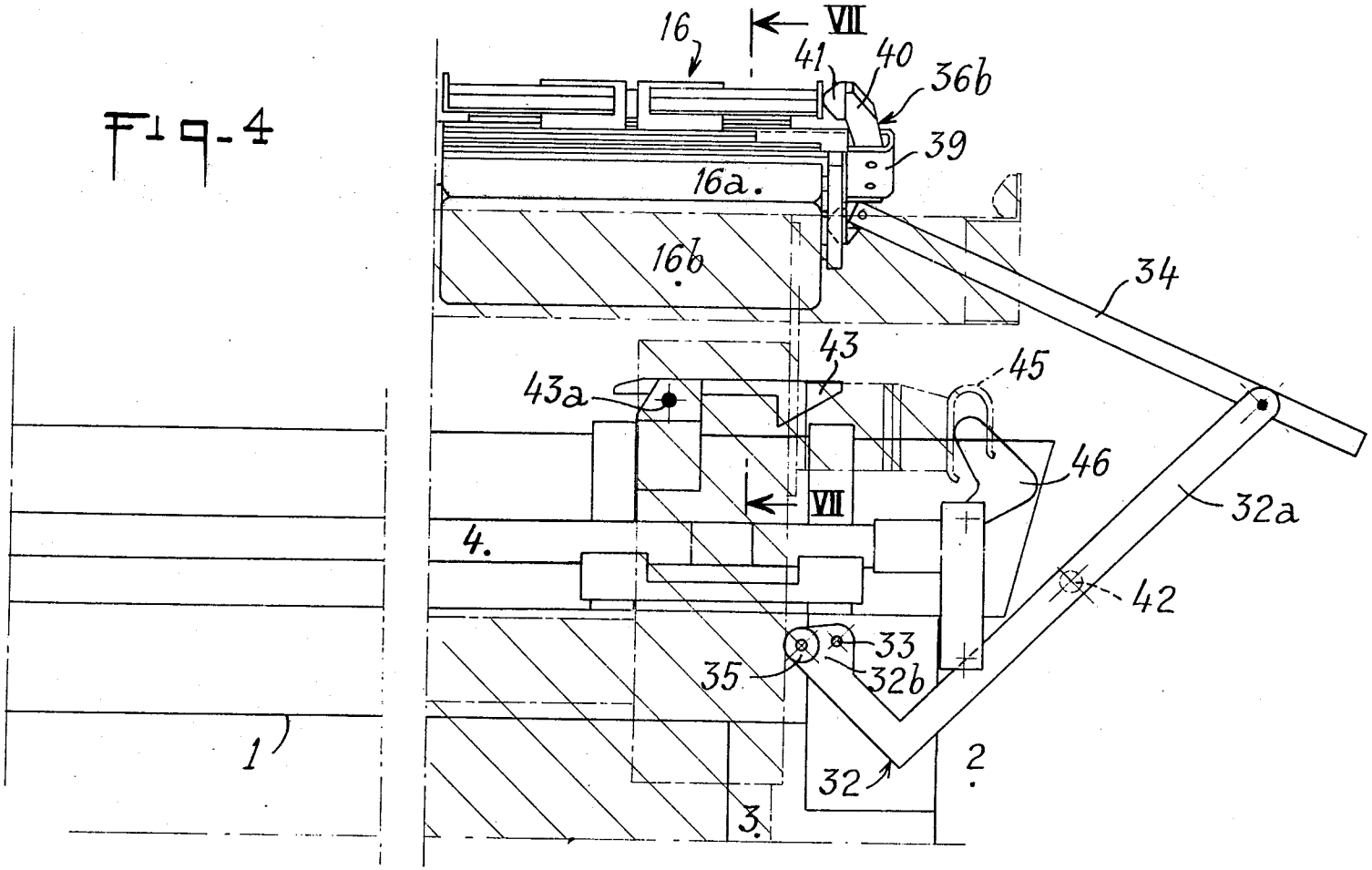
FIG. 4 is an elevation corresponding to that of FIG. 3, but in which the leaf is in its free sliding position and at the beginning of its opening run.
Figure 5:
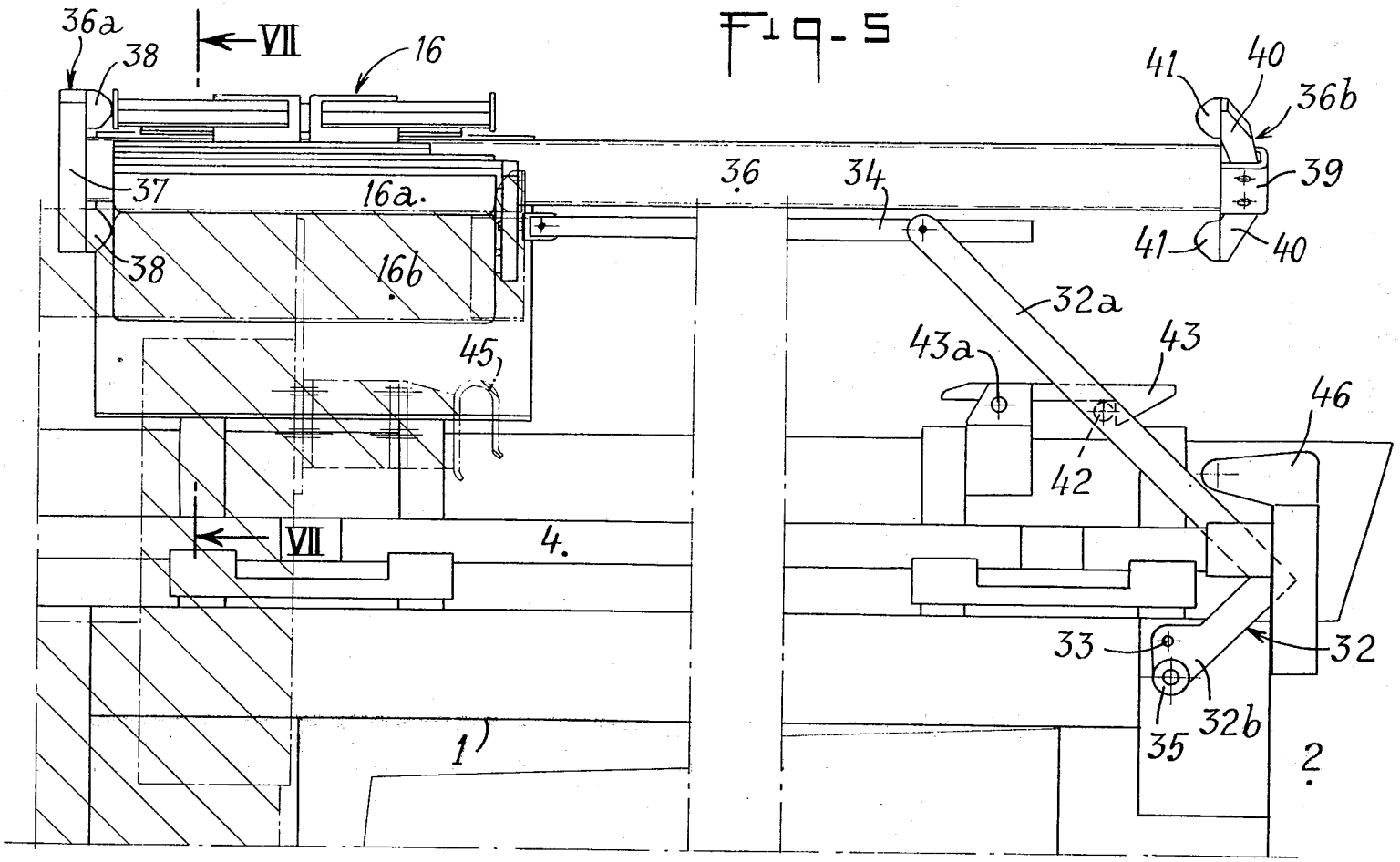
FIG. 5 is an elevation corresponding to FIGS. 3 and 4, in which the leaf is in the open position.

The operation of the control apparatus shown in FIGS. 3 to 7 is as follows. FIG. 3 shows an initial position in which leaf 3 is in the hermetic closure position and primary element 16*a* impinges against buffers 38 of stop 36*a*. With leaf 3 locked in the hermetic closure position, the primary 16*a* is provided with an electrical supply to allow the manoeuver of opening leaf 3. This supply causes the movement of element 16*a* from left to right in FIGS. 3 and 4, until the element 16*a* impinges against stop 36*b*. This motion of element 16*a* is accompanied by a pivoting motion of lever 32 about its axis 33, through an angle sufficient to allow leaf 3 to be placed in the disengaged position by the influence exercised on the leaf 3 by the end roller 35 of arm 32*b* of lever 32. The force of roller 35 on lateral edge face 3*c* has vertical and horizontal components of sufficient magnitude to move suspension rollers out of sections (b) of rail 4 onto sections (a) in a manner similar to the force provided on surface 5 in the FIG. 1 embodiment.

When element 16*a* impinges against stop 36*b*, a driving force is supplied by linear motor 16 to leaf 3, which has already been placed in its free sliding position, so that the opening of leaf 3 is determined. When leaf 3 is open, primary 16*a* is supplied to enable leaf 3 to be driven in the closure direction. The primary 16*a* then moves from right to left until it impinges against stop 36*a*. At that moment a locking lug 42 provided in a medial zone of the arm 32*a* of lever 32 enters into engagement with a latch 43 mounted to rock a horizontal axis 43*a* attached to wall 2, so that primary element 16*a* is locked in the limit position against stop 36*a*. Organs 42 and 43 constitute a locking device, which enables accidental motion of primary element 16*a* along slide 36 to be avoided, in the case of accidental reversal of the drive of linear motor 16. This locking device will only be released when leaf 3 reaches its closure limit position (see FIG. 3), in which position a finger 44 attached to secondary element 16*b* acts on an arm of latch 43 to lift the latter and releases lug 42.

On each lateral edge face of leaf 3 is provided a spring stirrup piece 45 which cooperates with a pneumatic organ 46 to deaden the motion of leaf 3 in the limit position and to lock the leaf 3 in the limit position.

It is therefore evident that there is provided in accordance with the present invention, a control apparatus associated with a device for hermetic closure of an opening formed in a wall that fully satisfies the objects, aims and advantages of the invention. While this invention has been described in conjunction with specific embodiments thereof, variations will be apparent to those skilled in the art. Accordingly, it is intended to embrace all alternatives, modifications and variations that fall within the spirit and broad scope of the appended claims.

What is claimed is:

1. Control apparatus associated with a device for hermetic closure of an opening formed in a wall, comprising: a leaf having seals positioned on a lower edge and on lateral and upper edges of its face which is turned towards the wall; a section rail rigidly attached to the wall; means for slidably mounting said leaf on said section rail; and movement and guiding means for moving and guiding said leaf between a disengaged position permitting free sliding of said leaf along said rail and a hermetic closure position which is lower than the disengaged position and in which said leaf is applied against the wall in the position of the opening to hermetically close said opening, said movement and guiding means including drive means for moving said leaf from the hermetic closure position into the free sliding position, and a linear electric motor for powering the sliding of said leaf, said motor including a first element and a second element rigidly attached to said leaf and electrically coupled to said first element, wherein said first and second elements of said linear motor are arranged relative to each other to cooperate with each other both when said leaf is in the disengaged position and when said leaf is in the hermetic closure position; wherein said drive means includes a double-arm lever having first and second arms and mounted to rock on an axis rigidly attached to the wall, and a rod pivotally connecting an end of said first arm to said first element of said linear motor, said second arm of said lever being arranged relative to said leaf to move said leaf from the hermetic closure position into the disengaged position; and further comprising two spaced apart stops attached to the wall; and a slide rigidly attached to the wall and parallel to the axis of sliding of the leaf, said first element being movably mounted along a limited path along said slide between said two stops.

2. Apparatus in accordance with claim 1, wherein said first and seond elements of said linear motor have opposite faces which are flat, mutually parallel and downwardly inclined to the vertical towards the wall, and wherein said means for moving and guiding moves said leaf along a substantially rectilinear path parallel to said opposite faces of said first and second elements.

3. Apparatus in accordance with claim 1 further comprising a locking lug provided in a median zone of said first arm of said lever of said drive means and engaging a catch mounted to oscillate on a shaft integral with the wall when said first element of said linear motor is in an end of course position, and a finger, integral with said second element, which releases said lug from said catch when said leaf is in a closure limit position.

4. Apparatus in accordance with claim 2 further comprising a locking lug provided in a median zone of said first arm of said lever of said drive means and engaging a catch mounted to oscillate on a shaft integral with the wall when said first element of said linear motor is in an end of course position, and a finger, integral with said second element, which releases said lug from said catch when said leaf is in a closure limit position.

5. Control apparatus associated with a device for hermetic closure of an opening formed in a wall, comprising: a leaf having seals positioned on a lower edge and on lateral and upper edges of its face which is turned towards the wall; a second rail rigidly attached to the wall; means for slidably mounting said leaf on said section rail; and movement and guiding means for moving and guiding said leaf between a disengaged position permitting free sliding of said leaf along said rail and a hermetic closure position which is lower than the disengaged position and in which said leaf is applied against the wall in the position of the opening to hermetically close said opening, said movement and guiding means including drive means for moving said leaf from the hermetic closure position into the free sliding position, and a linear electric motor for powering the sliding of said leaf, said motor including a first element and a second element rigidly attached to said leaf and elecrically coupled to said first element, wherein said first and second elements of said linear motor are arranged relative to each other to cooperate together when said leaf is in the disengaged position and to be out of action one from the other when said leaf is in the hermetic closure position, and wherein said drive means includes a double-arm lever having first and second arms and mounted on an axis fixed to the wall, a thrust surface connected to said leaf, said first arm having an end roller acting on said thrust surface, and a ram having first and second components, said second arm being pivoted on said first component and said second component being rigidly attached to the wall.

* * * * *